United States Patent [19]

Kita

[11] Patent Number: 4,902,012

[45] Date of Patent: Feb. 20, 1990

[54] BALL GAME PRACTICE APPARATUS

[76] Inventor: Shigeru Kita, 2-2-3, Showa-cho, Abeno-ku, Osaka, Japan

[21] Appl. No.: 142,528

[22] Filed: Jan. 11, 1988

[51] Int. Cl.[4] ..... A63B 69/38

[52] U.S. Cl. ..... 273/29 A; 273/26 EA

[58] Field of Search ..... 273/26 A, 26 E, 29 A, 273/413, 29 EA

[56] References Cited

U.S. PATENT DOCUMENTS

| | | | |
|---|---|---|---|
| 1,907,412 | 5/1933 | Zimmer | 273/26 EA |
| 3,630,521 | 12/1971 | Lingbeek | 273/26 EA |
| 3,658,330 | 4/1972 | Maestracci | 273/29 A |
| 3,703,286 | 1/1972 | Adkin | 273/26 EA |
| 3,924,855 | 12/1975 | Pretorious | 273/26 EA |
| 3,953,028 | 4/1976 | Gowins | 273/26 EA |
| 4,342,459 | 8/1982 | Pretorious | 273/26 EA |

*Primary Examiner*—T. Brown

*Attorney, Agent, or Firm*—Gifford, Groh, Sheridan, Sprinkle and Dolgorukov

[57] ABSTRACT

A ball game practice apparatus having a ball supported at a lower end of a dangling elastic member suspended from a middle portion of an elongate lateral elastic member supported by and fixed at its ends to an elongated frame having ends thereof held above a support surface and a practice board having a rebounding board at a front face thereof. The frame includes downward displacement limiting members disposed between the ends of the lateral elastic member for limiting downward displacements of the dangling elastic member. The rebounding board includes a plurality of concave-convex faces positioned adjacent at least one end of the frame.

6 Claims, 5 Drawing Sheets

BALL GAME PRACTICE APPARATUS

BACKGROUND OF THE INVENTION

1. FIELD OF THE INVENTION

The present invention relates to a ball game practice apparatus comprising a ball downwardly supported at a lower end of a dangling elastic expanding member and a practice board having a rebounding board at a front face thereof.

2. DESCRIPTION OF THE PRIOR ART

According to a conventional ball game, e.g. tennis practice method, a player strikes a ball against a wall face vertically extending from the ground face or against a flat board and then returns the rebounding ball. However, since such practice is monotonous, there have been developed various types of tennis practice apparatuses for providing more changeful practice. For example, according to a Japanese utility mode laid-open application No. 59-6856, a flat board is disposed with a slight inclination relative to its vertical position so as to provide a greater variety in the directions of the rebounding ball. Further, according to a Japanese utility model laid-open application No. 62-17100, there is provided a practice board bent at a middle portion thereof by a predetermined angle.

Referring now to the prior art practice ball device, there is known a practice ball device having a long rubber string with its one end being fixed to the ball body and its other end being fixed to a weight. Further, there is also known a practice apparatus in which a practice ball device is fixedly attached to an end of a rubber string downwardly suspended from a substantially central portion of another rubber string expandedly attached to and supported through ends thereof by a pair of support mounts (a Japanese utility model laid-open application No. 45-31300).

However, the above-described prior art practice apparatuses have problems to be described hereinafter. That is to say, the above walls or boards may provide rebouding ball conditions of only a small variety, which is far from actual game situations.

In the case of practice using a weight connected to a ball device and placed on the ground, when the rubber string is stretched to its maximum extent by the ball body hit by a player's racket, the elasticity of the ball decreases in the course of returning, whereby the ball inadvertently tends to roll on the ground or the floor. Even if the ball bounds thereon, the ball does not bound high, therefore it is impossible for the player to repeatedly hit the ball.

In the case of the practice ball fixedly attached to one end of vertically suspended rubber string, in order to reduce the rebounding speed of the ball thereby making it easier for the player to hit the same, the vertically suspended rubber string need have a considerable length such that the hit ball may fly as far as possible. As the result, the practice apparatus as a whole tends to be large occupying a large vertical space. Moreover, since the ball is suspended at a high altitude, the rebounding ball may be pulled too upwardly for the player to hit the same again. Also, if the rubber string expandedly supported by a pair of support mounts has a longer length, it is difficult to adjust the ball to a proper altitude since the ball tends to be considerably displaced downwardly at the suspended position.

Then, the applicant of the present invention devised a tennis practice apparatus capable of providing advanced practice condition even in a relatively small space (Japanese utility model laid-open application No. 62-11657). However, there has been still room for improvement in this apparatus with respect to the variety of practice situations.

SUMMARY OF THE INVENTION

Taking the above state of the art into consideration, a primary object of the present invention is to provide an improved ball game practice apparatus for use e.g. in tennis capable of providing changeful and advanced practice situation in which a player may repeatedly hit the ball since the bounding ball hit against a rebouding board returns with a proper altitude from the ground or the floor. It is another object of the present invention to provide an improved ball game practice apparatus which is formed compact and in which expansion amounts of elastic expanding members may be variably set in a wider range.

In order to accomplish the above objects, a ball game practice apparatus related to the present invention comprises a ball downwardly supported at a lower end of a dangling elastic expanding member downwardly and continuously suspended from a middle portion of an elongate lateral elastic expanding member supported by and fixed or loosely fixed to a frame having ends thereof held in the air and a practice board having a rebounding board at a front face thereof, wherein the frame includes downward displacement regulating members respectively disposed between loosely fixing portions of the lateral elastic expanding member to the frame and a connecting portion between the two elastic expanding members with the regulating members regulating downward displacements of the dangling elastic expanding member and wherein the rebounding board includes a plurality of concave-convex faces.

What is meant by 'fixed or loosely fixed' in the above description is not only that the elongate lateral elastic expanding member is fixed to the frame to be unmovable relative thereto but also that the member is attached to the frame such that the latter temporarily stops movements of the former. That is to say, the concept permits some movements of the elastic expanding member.

Functions and effects of the ball game practice apparatus related to the present invention will be described next.

Since the elongate lateral elastic expanding member is supported at its intermediate portions thereof thereby regulating the downward displacements of the connection portion between the two elastic expanding members, even if this lateral elastic expanding member as the whole has a large expansion amount, it is possible to keep relatively small the downward displacement of the member at the position from which the ball is suspended. That is, the expansion amount of the elastic expanding member as the whole may be set large without enlarging the whole practice apparatus. Moreover, since the elongate lateral elastic expanding member is fixed or loosely fixed to the frame at a relatively low altitude, the rebounding ball tends to return to the vicinity of its original suspended position whereby the player may readily hit the ball again.

As a result, according to the ball game practice apparatus related to the present invention, the rebounding ball having hit againt the rebounding board returns with keeping an appropriate altitude from the ground or from the floor face and at the same time returns substantially horizontally to the vicinity of its original position, whereby changeful, advanced thus practical practice situations may be provided.

BRIEF DESCRIPTION OF THE DRAWINGS

The accompanying drawings show preferred embodiments of a ball game practice apparatus related to the present invention; in which.

DESCRIPTION OF THE PREFERRED EMBODIMENTS

Preferred embodiments of a ball game practice apparatus for use e.g. as a tennis practice apparatus will be particularly described hereinafter with reference to the accompanying drawings.

Figure 1:
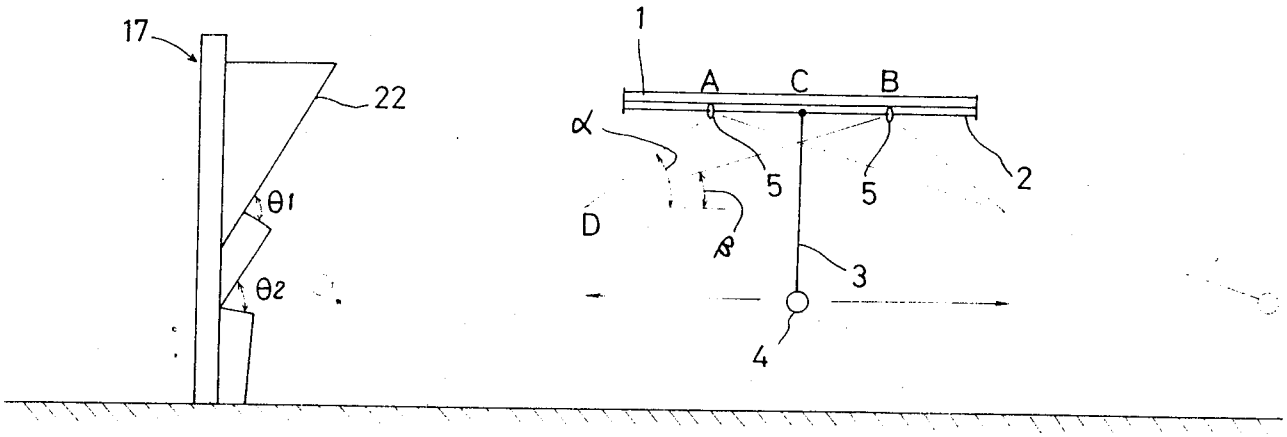
FIG. 1 is a principle construction view.

As shown in FIG. 1 which illustrates a basic construction embodying the principle of the present invention, when a ball 4 suspended centrally in the same figure is hit by a player's racket, a dangling elastic expansing member 3 is expanded and at the same time an elongate lateral elastic expanding member 2 disposed along a frame 1 is also expanded. Chain lines in the this figure illustrate conditions in which these expanding members are expanded to their maximum extents. When the ball 4 is hit towards a practice board, a line segment ratio BD/BC is considerably larger than a line segment ratio AD/AC and an angle $\alpha$ of the line segment AD relative to the horizontal line is considerably larger than an angle $\beta$ of the line segment BD relative to the same.

That is to say, the line segment portion BD of the elastic expanding member 2 along the frame 1 is sufficiently expanded thereby providing sufficient returning force to the ball 4. Therefore, the ball 4 rebounding from a rebounding board of the practice board has a variety of rebounding forces and angles but always returns to the vicinity of the position where the ball is originally hit. Since the horizontal returning force is sufficiently larger than the vertical returning force, the rebounding ball 4 may return to the original hit position substantially horizontally.

Further, since the ball 4 is fixed to a lower end of the dangling elastic expanding member 3, it is possible to maintain the ball 4 at its free state floating from the ground face or the floor face. More specifically, it is possible to set and maintain the ball 4 at a position near the player's knees or waist having an altitude convenient for ball hitting.

Moreover, since the ball 4 is connected to the combination of the dangling elastic expanding member 3 and the lateral elastic expanding member 2, it is possible to set the carry (flying distance) of the ball longer compared with the prior art construction using the dangling elastic expanding member alone.

The deadweight of the ball 4 causes an expansion of the lateral elastic expanding member 2 disposed along the frame 1; thus, even if a connecting portion 'C' between the two elastic expanding members 2, 3 is downwardly displaced, since the lateral elastic expanding member 2 is supported at portions 'A' and 'B' forwardly and rearwardly across the portion 'C', the downward expansion of the lateral elastic expanding member 2 occurs as being bent from these portions 'A' and 'B'. Therefore, unlike the prior art arrangement in which the downward expansion of the member occurs straightly from the fixed ends thereof without any intermediate bends, the connecting portion 'C' may be maintained at a higher altitude provided the same expansion amount.

The ball 4 hit by the player strikes againt a rebounding board 22 provided on a surface of the practice board 17 and having concave and convex faces and the ball is provided with a variety of rebounding forces and angles in accordance with various angles $\theta 1$, $\theta 2$ formed by the concave and convex faces. The rebounding ball usually drops onto the ground and returns with a single bound to the vicinity of the position where the ball was originally hit by the player. Then, the player may hit the ball again, whereby a continuous and repetitive practice is possible.

Nextly, a specific construction of the ball game practice apparatus related to the present invention will be particularly described.

Figure 2:
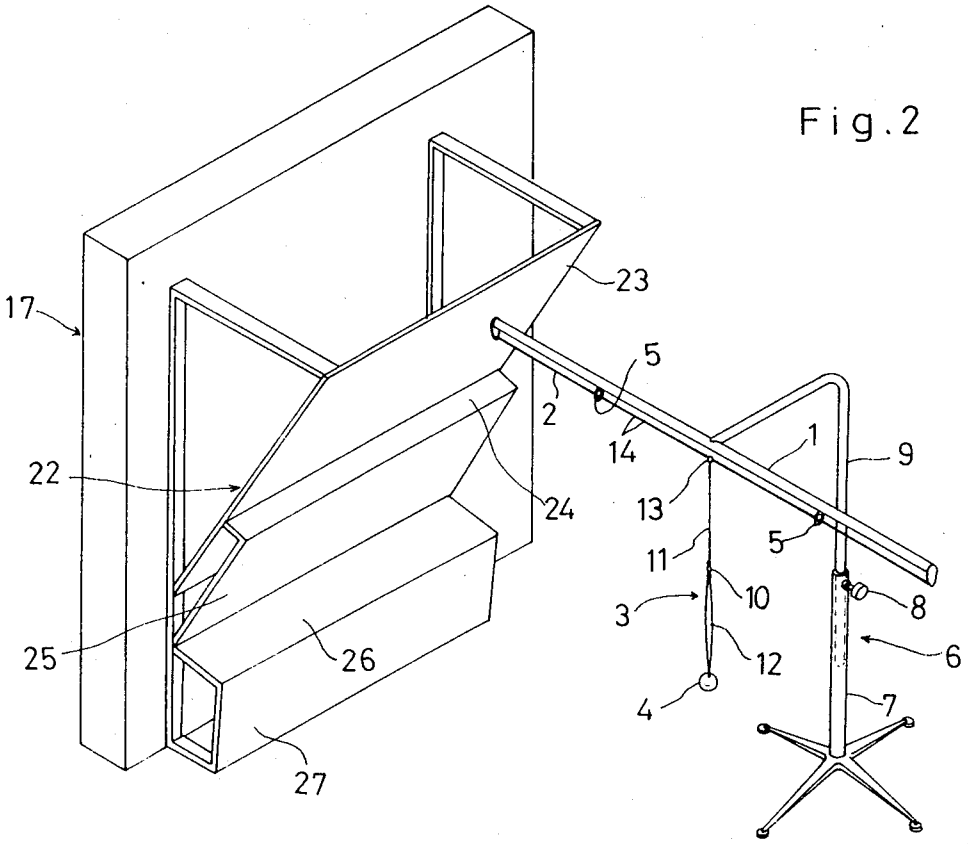
FIG. 2 is a perspective view showing an overall construction.

Referring to FIG. 2, the frame 1 disposed in the forward-backward direction is supported by a ground support member 6. This ground support member 6 includes a setting leg 7 on which a weight may be placed and an L-shaped post 9 which is vertically and slidably inserted from above into the leg 7 and fixedly positioned by a fixing member 8. To a top end of the post 9, a central portion of the frame 1 is fixed.

The dangling elastic expanding member 3 includes rubber strings 11, 12 respectively connected upwardly and downwardly across a twist 10. To an end of the upper rubber string 11, there is attached a connecting member 13 attachable to and detachable from the lateral elastic expanding member 2. The lower rubber string 12 is formed as a loop.

Figure 3:
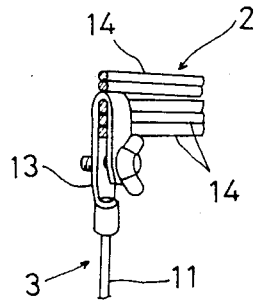
FIG. 3 is a partially cutaway perspective view showing a connecting portion.

The lateral elastic expanding member 2, as shown in FIG. 3, is constituted by a plurality of rubber strings 14, to and from some of which the connecting member 13 is attachable and detachable. The connecting member 14 is designed to forcefully tighten by a screwing motion the rubber strings 14. The frame 1 is formed of a pipe and downward displacement regulating members 5, 5 for the rubber strings 14 comprise rings.

Forwardly of the frame 1, there is disposed the practice board 17 including the rebounding board 22 formed of a plurality of concave and convex faces. More particularly, this rebounding board 22 has a first face 23, a second face 24, a third face 25, a fourth face 26 and a fifth face 27, with the first face 23 and the second face 24 forming a pair of concave and convex faces and the third face 25 and the fourth face 26 forming another pair of concave and convex faces. By conveniently varying the angles 01 and 02 formed by these concave and convex faces, it becomes possible to provide the rebounding ball with a variety of rebounding conditions. Therefore, these angles may be either the same or different from each other. That is, these angles formed by the concave and convex faces may be conveniently varied. Also, needless to say, the number of the concave and convex faces need not be two as shown in the same figure but may be conveniently varied as well. If there are more than two of these concave and convex faces, the rebounding ball will have a greater variety of rebounding conditions. Also, it is to be noted here, it is convenient if the fifth face 27 is set to substantially the same altitude as a net.

(Alternate Embodiments)

Figure 4:
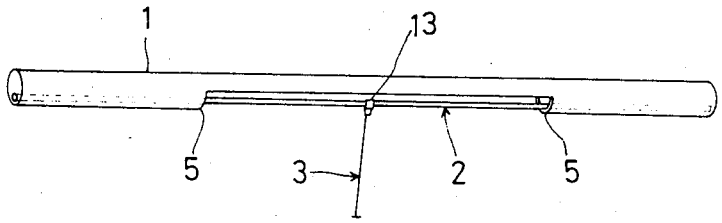
FIG. 4 is a perspective view showing a frame according to another embodiment of the present invention.

As shown in FIG. 4, a pipe is used to form the frame 1, into which the elastic expanding member 2 is inserted with a bottom of a middle portion of the pipe being cut away for exposing the elastic expanding member 2. In this arrangement, the remaining bottom of the pipe acts as the downward displacement regulating members 5, 5 for the elastic expanding member 2.

Figure 5:
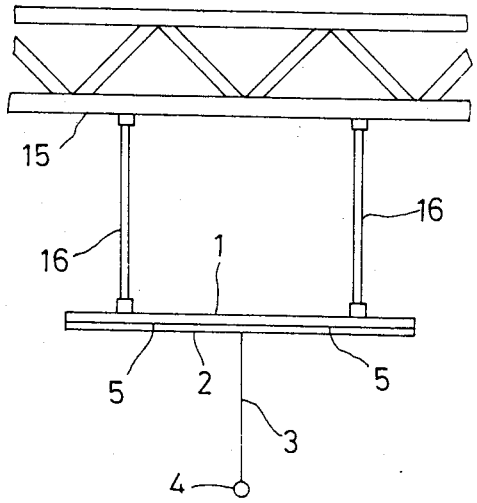
FIG. 5 is a view showing a ball suspending condition provided by a construction according to still another embodiment of the present invention.

Further, as shown in FIG. 5, the frame 1 is suspended via vertical frames 16, 16 from an upper structure 15. This arrangement is particularly convenient for use e.g. at a gymnasium.

In place of the rubber strings, the elastic expanding members may also be formed of such elements as a coil spring.

Figure 6:
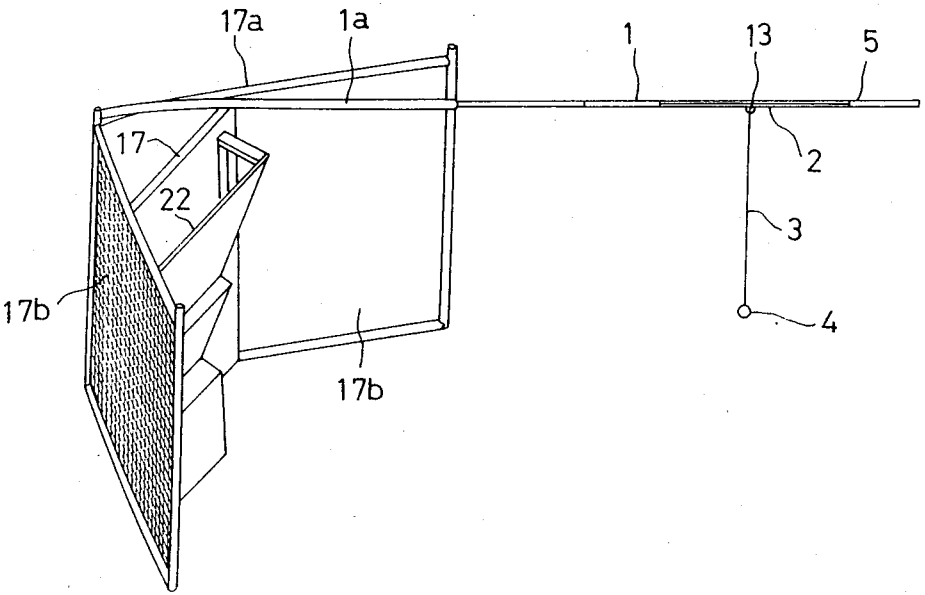
FIG. 6 is a perspective view showing an overall construction of a ball game practice apparatus according to still another embodiment of the present invention.

In the case of the construction shown in FIG. 2, the ball is suspended from the ground support member 6. Instead of this, in an alternate construction shown in FIG. 6, the practice board 17 is designed as a standing panel, and the frame 1 is connected to a bar 1*a* extending from an upper end of a standing panel 17*a* and partially supported by an upper side portion of the practice board 17 with the ball 4 being suspended from the frame 1. In this case, it will be very convenient if the bar 1*a* is connected to the upper end of the standing panel 17*a* to be pivotable relative thereto. The user may conveniently fix the bar 1*a* at a convenient position by using a stopper.

This standing panel 17*a* has an 'L' configuration when seen in its plane view and has its wall portions 17*b* formed of meshes or plates. This arrangement uses the same downward displacement regulating member 5 as that employed in the arrangement shown in FIG. 4. Needless to say, the downward displacement regulating member 5 may be also formed of rings in this arrangement as well.

This arrangement is advantageous in that the player will have a larger action area and therefore more changeful practice situation.

Figure 7:
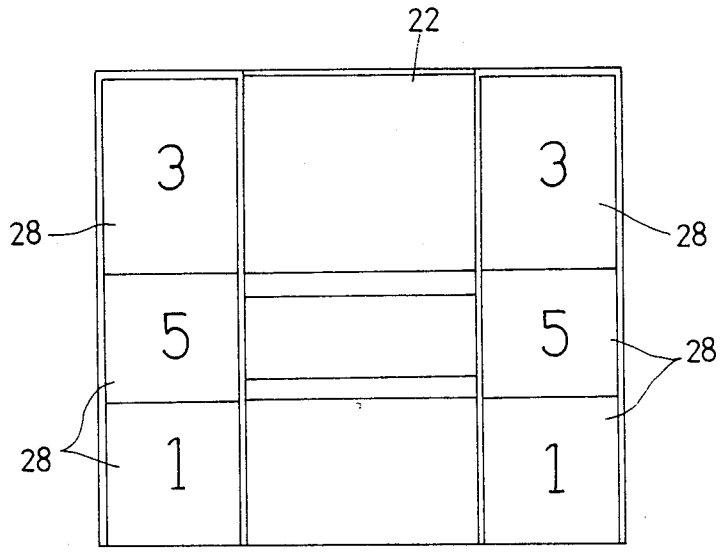
FIG. 7 is a front view showing a practice board according to another embodiment.

Further, as shown in FIG. 7, a plurality of flat plate like targets 28 are provided at the sides of the rebounding board 22 formed on the surface of the practice board 17. These respectively carry thereon a certain number, such that e.g. two players hit the ball rebounding from the rebounding board 22 against the targets 28 and compete with each other by the points. With this arrangement, more than two players play and at the same time practice tennis utilizing the apparatus of the present invention as a plaything, whereby the practice will be more changeful and enjoyable.

Figure 8:
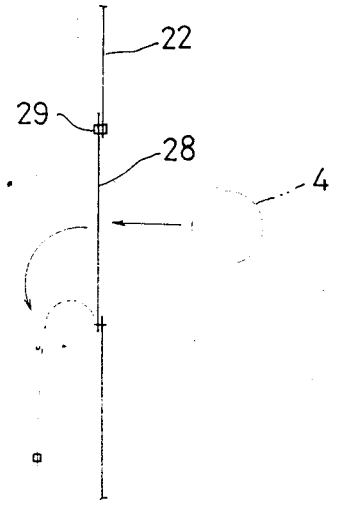
FIG. 8 is a partially sectional view of FIG. 7.

In this case, as shown in FIG. 8, it is also possible to provide an additional arrangement in which each target 28 falls off as its clip 29 detaches therefrom when the ball 4 hits the target 28.

Also, the surface of the rebounding board need not be formed flat but may be formed with a plurality of small projections so as to provide more variety in the rebounding conditions of the ball from the rebounding board.

Further, a shock absorbing material (e.g. sponge) may be provided partially over the surface of the rebounding board for providing the same effect.

In the above, the ball game practice apparatus related to the present invention is described as a tennis practice apparatus. However, by conveniently varying the kind or the suspended position of the ball, this apparatus may be also employed for practice of various ball hitting or kicking games such as racket ball, squash tennis, soccer, football and hockey.

I claim:

1. A ball game practice apparatus comprising:

a ball;

an elongated horizontally extending frame member supported above a support surface by support means;

a first elongated elastic member having first and second ends, said ends being spaced apart and fixed to said frame member at spaced locations thereon, said first elastic member extending substantially along the length of said frame member;

a second elastic member having a first end and a second end, said first end of said second elastic member being fixed to said first elastic member at a point located between said first and second ends of said elastic member and said second end of said second elastic member being fixed to said ball, said second elastic member thereby suspending said ball;

limiting means on said frame between said first and second end of said first elastic member for limiting downward movement of said first elastic member intermediate said first and second ends; and a rebounding board having a surface against which said ball can rebound when struck, said surface including a plurality of arbitrarily arranged rebounding faces positioned adjacent at least one end of said elongated frame member.

2. A ball game practice apparatus as claimed in claim 1, wherein said stopper means comprises rings surrounding said first elastic member.

3. A ball game practice apparatus as claimed in claim 2, wherein said plurality of arbitrarily arranged faces comprises a plurality of planes angled differently from one another.

4. A ball game practice apparatus as claimed in claim 1, wherein said plurality of arbitrarily arranged faces comprises a plurality of planes angled differently from one another.

5. A ball game practice apparatus as claimed in claim 1, wherein said plurality of faces includes at least one concave and at least one convex face.

6. A ball game practice apparatus as defined in claim 1, wherein said practice board further includes targets disposed at both sides of said rebound board.

* * * * *